United States Patent [19]

Murphy

[11] Patent Number: 4,482,019

[45] Date of Patent: Nov. 13, 1984

[54] EARTH SURFACE CLEANING MACHINE

[76] Inventor: Donald G. Murphy, 14 Chippewa, Lake Barrington, Ill. 60010

[21] Appl. No.: 392,876

[22] Filed: Jun. 28, 1982

[51] Int. Cl.[3] ..... A01D 17/00

[52] U.S. Cl. ..... 171/63; 171/130; 172/96

[58] Field of Search ..... 171/63, 64, 65, 110, 171/134, 130, 126, 117, 101, 111, 124, 85, 95, 98, 130, 131; 172/96, 112

[56] References Cited

U.S. PATENT DOCUMENTS

| | | | |
|---|---|---|---|
| 965,115 | 7/1910 | Moore | 171/63 |
| 1,388,953 | 8/1921 | Knight | 172/96 |
| 1,563,340 | 12/1925 | Christenson | 171/63 X |
| 2,693,746 | 11/1954 | Klein | 172/96 |
| 2,698,506 | 1/1955 | Rushfeldt | 171/110 |
| 3,126,656 | 3/1964 | Blackwell | 172/96 X |
| 4,014,390 | 3/1977 | Teixeira | 171/63 |
| 4,121,667 | 10/1978 | Curl | 171/110 |
| 4,221,265 | 9/1980 | Pratt | 171/63 |
| 4,241,792 | 12/1980 | Kratzer | 171/61 |

FOREIGN PATENT DOCUMENTS

| | | | |
|---|---|---|---|
| 457447 | 3/1975 | U.S.S.R. | 171/63 |

*Primary Examiner*—Richard J. Johnson
*Attorney, Agent, or Firm*—Thomas R. Vigil

[57] ABSTRACT

The earth surface cleaning machine is utilized for cleaning on or just beneath the earth surface on land or in water. The machine is connected to, operated from, and pulled by a vehicle, such as a tractor. The elements of the machine include a rotatable tine assembly for skimming material from the earth surface, a transfer conveyor for transferring debris and small earth particulate matter to a screening conveyor where the debris is screened from the particulate matter and a collection hopper mounted on a trailer carriage and to which the screening conveyor delivers the debris.

47 Claims, 10 Drawing Figures

EARTH SURFACE CLEANING MACHINE

EARTH SURFACE CLEANING MACHINE

1. Field of the Invention

The present invention relates to an earth surface cleaning machine and particularly a machine which is adapted to clean surface and subsurface debris on a beach.

2. Description of the Prior Art

Heretofore various devices adapted from tuber vegetable harvesting machines such as potato harvesting machines and peanut harvesting machines have been utilized in attempts to clean debris from beaches. However, such devices, such as a potato harvesting machine, have not proved satisfactory in cleaning debris, such as broken glass, fish, cigarette butts, articles of clothing, stones, tar balls, beer cans, bottles, paper and other kinds of debris commonly found on beaches, from a beach.

As will be described in greater detail hereinafter, the earth surface cleaning machine of the present invention differs from the previously proposed machines utilized for this purpose by providing a machine which has a skimming section for skimming material from the surface or subsurface of the earth surface to be cleaned, a transfer section for transferring the skimmed material and small earth particulate matter, such as sand to a screening and delivery section where the material is screened from the small earth particulate matter while it is being carried to a collection section where it is delivered for collection.

SUMMARY OF THE INVENTION

An earth surface cleaning machine for cleaning earth surfaces such as beaches, said machine including hitch means connectable to and adapted to be operated from and pulled by a vehicle such as a tractor, said machine comprising: a first wheeled carriage, skimming means, conveyor transfer belt means, and conveying and screening means on said carriage, said skimming means comprising a plurality of spaced apart tines mounted on a shaft extending traversely of and journalled at the front end of said first carriage for skimming material from the earth surface as said machine is pulled over the earth surface by a vehicle, a hood over said tines, drive means for rotating said shaft in a direction so as to cause said tines to engage or skim the earth surface to engage and lift skimmed material forwardly of the direction of movement of said first carriage adjacent and along the undersurface of said hood in an upward rearward movement to be deposited on said conveyor transfer belt means to be conveyed and deposited on said conveying and screening means for conveying and simultaneously screening the skimmed material from small earth particulate material, such as sand, transferred thereto by said conveyor transfer belt means, and receptable means for collecting the screened material delivered thereto by said conveying and screening means.

DESCRIPTION OF THE PREFERRED EMBODIMENT

Figures 1, 2:
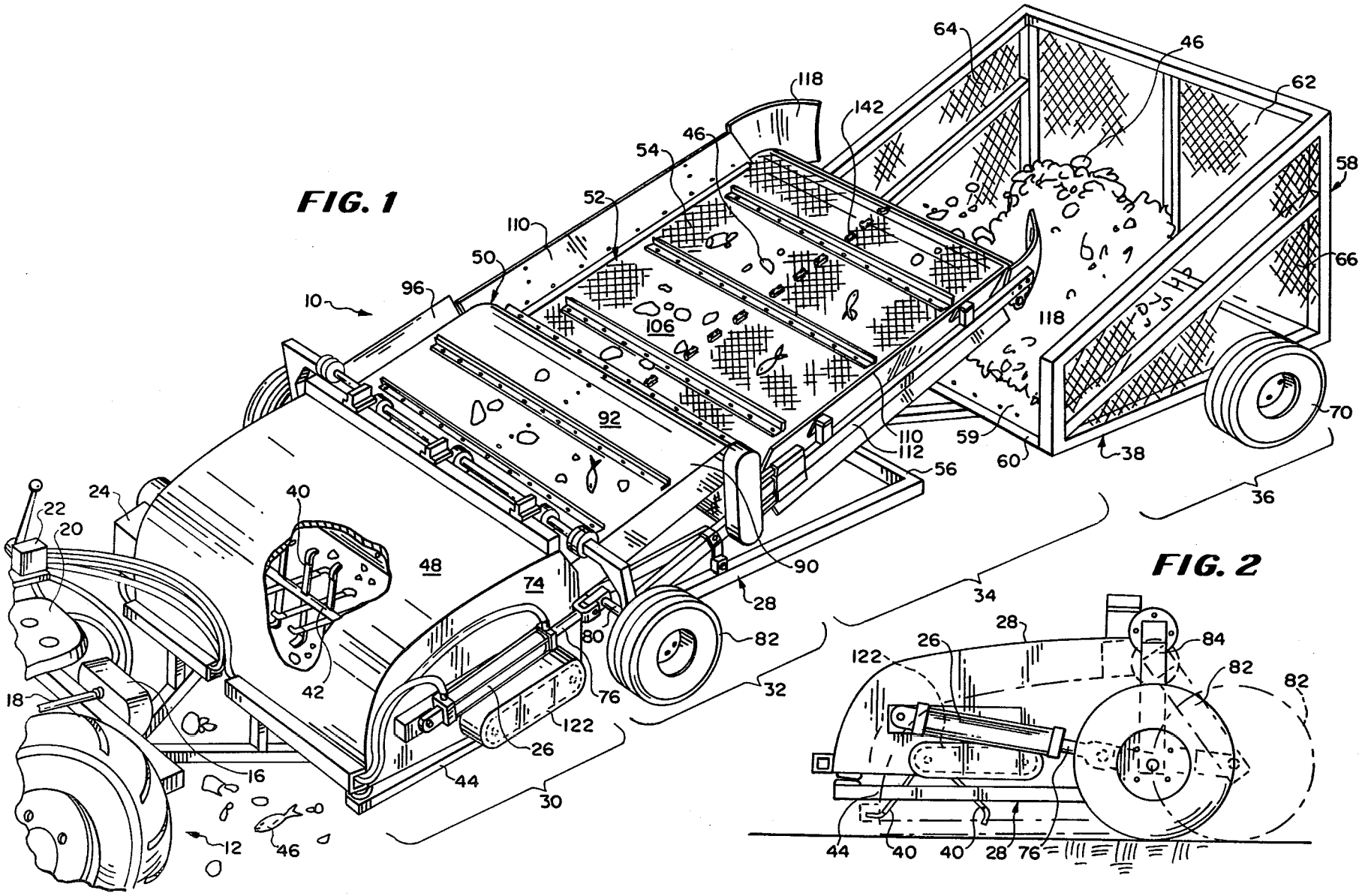
FIG. 1 is a perspective view with portions broken away of the earth surface cleaning machine of the present invention.
FIG. 2 is a fragmentary side elevational view of the front portion or skimming section of the machine shown in FIG. 1.

Referring now to the drawings in greater detail there is illustrated in FIG. 1 an earth surface cleaning machine 10 constructed in accordance with the teachings of the present invention. The machine 10 is designed to be pulled by a vehicle such as a tractor 12 only a portion of which is shown in FIG. 1.

As will be described in greater detail hereinafter in connection with the description of FIG. 10, the machine 10 is operated by a hydraulic system 14 (FIG. 10) which includes a pump 16 mounted on the tractor 12 and driven by a power take off shaft 18 of the tractor 12. The system 14 further includes a reservoir 20 and a flow control valve 22 mounted on the tractor 12 and a hydraulic motor 24, which can be of the type manufactured by Charylin Company, a division of Eaton Manufacturing Co., and a piston and cylinder mechanism 26, both mounted on a first carriage 28 of the machine 10. The hydraulic system 14 and its manner of operation are described in further detail hereinafter in connection with the description of FIG. 10.

Returning to FIG. 1, the machine 10, starting from front to rear, includes an earth skimming section 30, a material transfer section 32, an earth screening and material delivery section 34 and a material collection section 36 which receives screened material from the screening and delivery section 34. The skimming section 30, the transfer section 32 and the screening and delivery section 34 are located on the first carriage 28 and the material collecting section 36 is located on a second carriage 38.

In the use of the machine 10, the portions of the hydraulic system 14 that are to be mounted on the tractor 12 are first mounted on the tractor 12 so that the machine 10 is ready for operation. Then, an operator driving the tractor 12 will pull the machine 10 over the earth surface area to be cleaned such as a beach. When the machine 10 is pulled over the beach, a plurality of tines 40 mounted on a shaft 42 journalled on a forward framework portion 44 of the first carriage 28 rotate in a clockwise direction to rotate into the sand rearwardly of the direction of travel of the machine 10 to scoop up the sand and debris 46 and carry it forwardly and upwardly past a hood or cowling 48 mounted on the forward framework portion 44 to a transfer conveyor 50 at the transfer section 32.

The transfer conveyor 50 serves to move the sand and debris 46 from the area of the skimming section 30 so that such sand and debris 46 does not clog up the machine 10 at the forward end thereof.

The sand and debris is carried by the conveyor 50 to the screening and delivery section 34 which includes a screening and delivery conveyor 52 having its forward end mounted just below the rearward end of the transfer conveyor 50. The screening conveyor 52 includes a continuous mesh conveyor belt 54 which will be described in greater detail hereinafter and through which sand or small earth particulate matter can fall to the earth surface to and around a frame member 56 of the first carriage 28.

From the screening and delivery conveyor 52, the debris 46 is dropped into a collection hopper 58 mounted on the second carriage 38 at the collection section 36 of the machine 10.

The collection hopper 58 has a mesh bottom wall 59 mounted on a frame member 60 of the carriage 38, a mesh back wall 62 and opposed trapezoidal shaped mesh side walls 64 and 66. The trapezoidal side walls 64 and 66 have a short vertical edge at the front thereof defining therebetween an open front end of the collection hopper 58 for receiving material from the screening and delivery conveyor 52. As shown, the rear end of the conveyor 52 is located above the open front end of the collection hopper 58. Each trapezoidal side wall 64 and 66 inclines rearwardly to a rear edge thereof which also forms a side edge of the back wall 62.

The frame member 60 of the second carriage 38 has an axle (hidden from view) mounted therebeneath, on the ends of which are mounted a pair of wheels 70.

With this construction the collection hopper 58 on the wheeled second carriage 38 form a trailer which has a hitch (hidden from view) at the forward end thereof for coupling to a ball 72 (FIG. 4) mounted on the rear frame member 56 of the first carriage 28.

Figure 4:
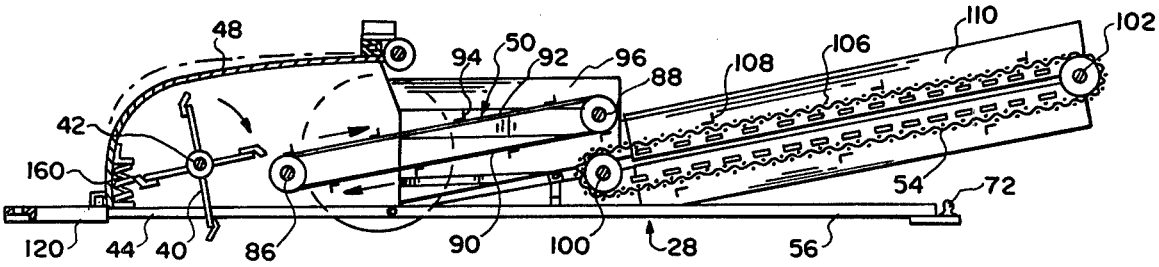
FIG. 4 is a sectional view of the machine taken along line 4—4 of FIG. 3.
Figure 5:
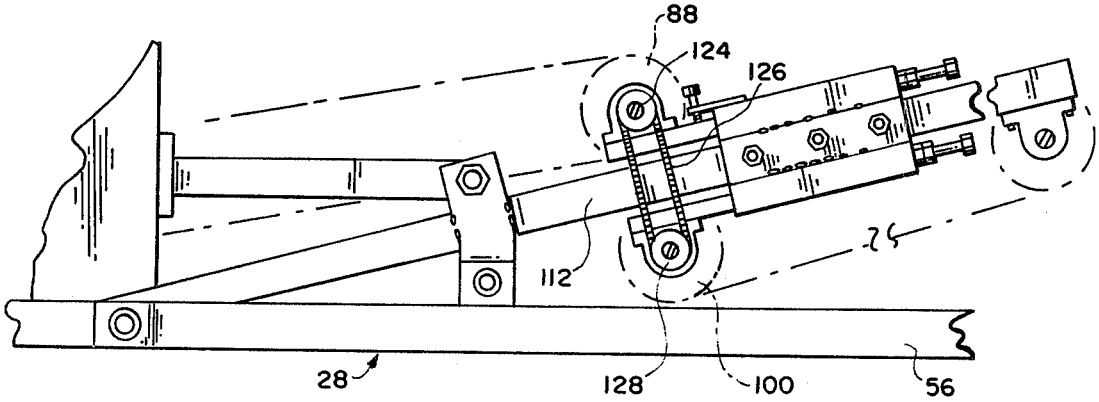
FIG. 5 is a fragmentary side elevational view of the middle portion of the machine and shows the mounting and drive connection between several rollers of the conveyors of the machine.

Referring to FIGS. 1, 2 and 4, it will be apparent that the skimming section 30 includes a tine assembly comprising the tines 40 mounted on the shaft 42 which is journalled on the forward framework portion 44 of the first carriage 28 between opposed side walls of the hood 48. At one end thereof, the shaft 42 is driven by an output shaft (not shown) of the hydraulic motor 24. Again, as described above, the tines 40 rotate in a clockwise direction to scoop up material rearwardly of the path of movement of the machine 10 and scoop forwardly beneath the machine 10 and then upwardly past the curved surface of the hood 48 to the transfer conveyor 50.

As shown in FIGS. 1 and 2, the piston and cylinder mechanism 26 is mounted to a side wall 74 of the hood 48 and has a piston 76 extending therefrom which engages a shaft 80 having a wheel 82 mounted on each end thereof. The shaft 80 is journalled to the lower ends of a U shaped frame member 84 which is pivotally mounted on its upper bight portion to the hood 48.

With this arrangement, extension of the piston 76 will cause the forward frame portion 44 of the first carriage 28 to be lowered as shown in phantom in FIG. 2 as the wheels 82 are moved rearwardly and is raised to the position shown in FIG. 2 when the piston 76 is retracted within the piston and cylinder mechanism 26 as shown in FIG. 2. As a result, operation of the piston and cylinder mechanism 26 controls the depth at which the tines 40 engage the earth surface. Depending upon the length of the tines 40 and the length of the legs of the frame member 84, the forward end of the machine 10 can be constructed so that the tines 40 can skim from a height of 2 inches above the earth surface to a depth of 12 inches beneath the earth surface.

Referring now to FIG. 4 it will be apparent that the transfer conveyor 50 includes a forward roller 86 and a rearward roller 88 on which is trained a wide conveyor belt 90. Also it will be apparent that the upper active flight 92 of the conveyor 50 is at an incline to the horizontal which can be from 15° to 50° and will vary as the wheels 82 are moved forwardly or rearwardly by the piston and cylinder mechanism 26 and as the wheels 82 sink into the earth surface, such as soft sand.

The conveyor belt 90 is made of two plies of a rubber material and is approximately 4 feet wide and has a total length such that the active flight 92 extends between 2 and 4 feet from the skimming section 30 to the screening and delivery section 34.

To facilitate the carrying of the material or debris 46 from the tines 40 to the screening and delivery conveyor 52, the conveyor belt 90 is provided with a plurality of longitudinally spaced, transversely extending ribs 94. Preferably these ribs 94 are made of an elastomeric material and secured in a suitable manner to the conveyor belt 90.

To prevent debris 46 such as rocks or pieces of wood from being thrown off of the machine 10, the conveyor 50 has side deflectors 96 positioned on either side thereof with the side deflector 96 on one side of the machine shown in FIG. 1 omitted from the Figure. These side deflectors 96 are positioned at an angle so as to form a shallow, V-shaped trough with the top flight 92 of the conveyor belt 90. Also, and as will be described in greater detail in connection with the description of the screening conveyor 52 with reference to FIG. 7, each of the side deflectors 96 has an elastomeric skirt fixed to the bottom edge thereof which extends toward and engages one side edge of the top flight 92 of the conveyor belt 90 so as to prevent material from falling beneath the upper active flight 92 of the conveyor belt 90 into the space between the upper and lower flights of the conveyor belt 90.

The screening and delivery conveyor 52 is mounted so that the forward end thereof is located beneath the rearward end of the transfer conveyor 50 as shown in FIG. 4. In this respect, a forward roller 100 is mounted beneath the rearward roller 88 of the transfer conveyor 50 and a rearward roller 102 is mounted above the ball 72 and above the open end of the collection hopper 58. As shown, continuous mesh conveyor belt 54 is trained over the rollers 100 and 102. An upper active flight 106 of the conveyor belt 54 extends at an angle to the horizontal, substantially identical to the angle of the active flight 92, which is between 15° and 50°. It will be obvious that as sand and debris 46 is carried by the transfer conveyor 50 to the screening and delivery conveyor 52 the sand will fall through the mesh of the screen mesh belt 54 onto the earth surface and the debris will be carried on the screen mesh conveyor belt 54 to the hopper 56.

As with the transfer conveyor belt 90, the screening mesh conveyor belt 54 has a plurality of longitudinally spaced, transversely extending ribs 108 secured thereto, such ribs preferably being made of a rubber-like or elastomeric material and serving to hold material 46 on the conveyor belt 54 as the material 46 is being carried to the collection hopper 58.

The continuous wire mesh conveyor belt 54 has a length such that the active flight 106 thereof extends approximately 5 to 6 feet in length. Also, of course, the width of the conveyor belt 54 is approximately 4 feet, the same width as the width of the transfer conveyor belt 90.

Figure 7:
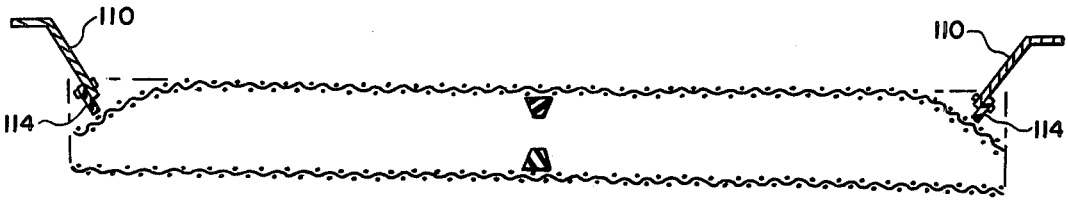
FIG. 7 is a vertical sectional view of the screening and delivery conveyor of the machine and is taken along line 7—7 of FIG. 3.

As with the transfer conveyor 50, the screening and delivery conveyor 52 has side deflectors 110 which are mounted to a frame member 112 each of which extends on either side of and upwardly from the frame member 56 of the first carriage 28. These side deflectors 110 are each angled downwardly toward the mesh conveyor belt 54 so as to form a shallow V shaped trough with the upper active flight 106 of the belt 54. Also and as best shown in FIG. 7, the lower edge of each of the side deflectors 110 has an elastomeric or rubber skirt 114 which engages a side edge of the active flight 106 of the mesh conveyor belt 54. The skirts 114 will be worn down during use until there is only a slight touching or engagement between the upper flight 106 and the worn edge of the skirts 114. However, the side deflectors 110 and the skirts 114 serve to maintain debris on the upper active flight 106 as this debris or material 46 is being carried to the collection hopper 58.

Additionally at the rear end of the screening and delivery conveyor 52 and mounted to the ends of the side deflectors 110 are end deflectors 118 which deflect material 46 inwardly and downwardly into the hopper 58 as shown. For this purpose, the end deflectors 118 are curved inwardly and downwardly as shown in FIGS. 1 and 3.

Figure 3:
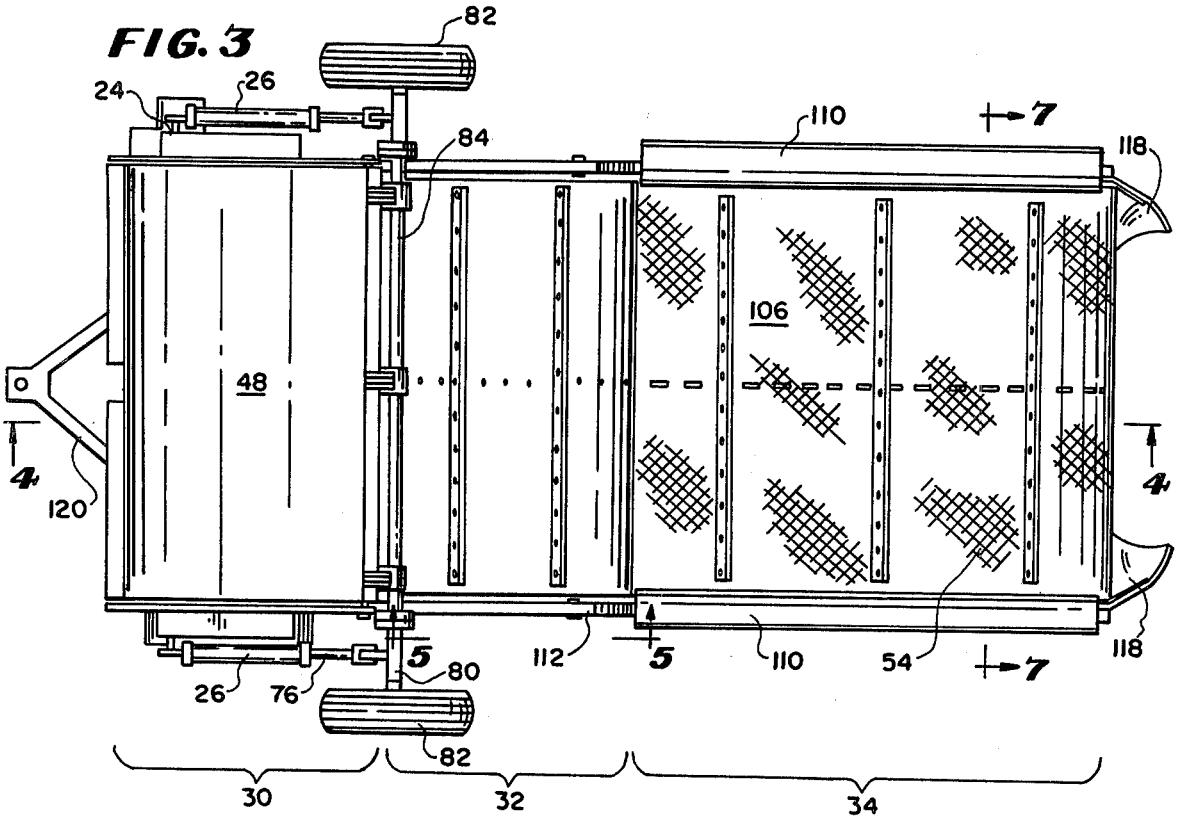
FIG. 3 is a top plan view of the machine shown in FIG. 1.

As shown in FIGS. 1, 3 and 4, a hitch 120 is fixed to the forward frame portion 44 of the first carriage 28 and is adapted to mate with a ball (not shown) on the rear end of the tractor 12.

It will be apparent that the shaft 42 is rotated by the hydraulic motor 24 to rotate the tines 40 in the clockwise direction shown in FIG. 4. Then the other end of the shaft 42 has a pulley (not shown) mounted thereon for coupling the shaft 42 by a belt 122 shown in phantom in FIG. 1 to the roller 86 for rotating the roller 86.

Then, the rearward roller 88 of the transfer conveyor 50 has a pulley 124 on one end thereof over which a belt 126 is trained for drivingly engaging another pulley 128 at the end of the forward roller 100 such that rotation of the roller 88 will drive the roller 100 to drive the screening and delivery conveyor 52.

By reason of the use of a totally enclosed hydraulic motor 24 and the simple belt and pulley mechanical linkages between the rotating tine assembly, the transfer conveyor 50 and the screening and delivery conveyor 52, the machine 10 is very rugged and can withstand much abuse from particulate matter such as sand and fresh or salt water and still function properly.

Figure 6:
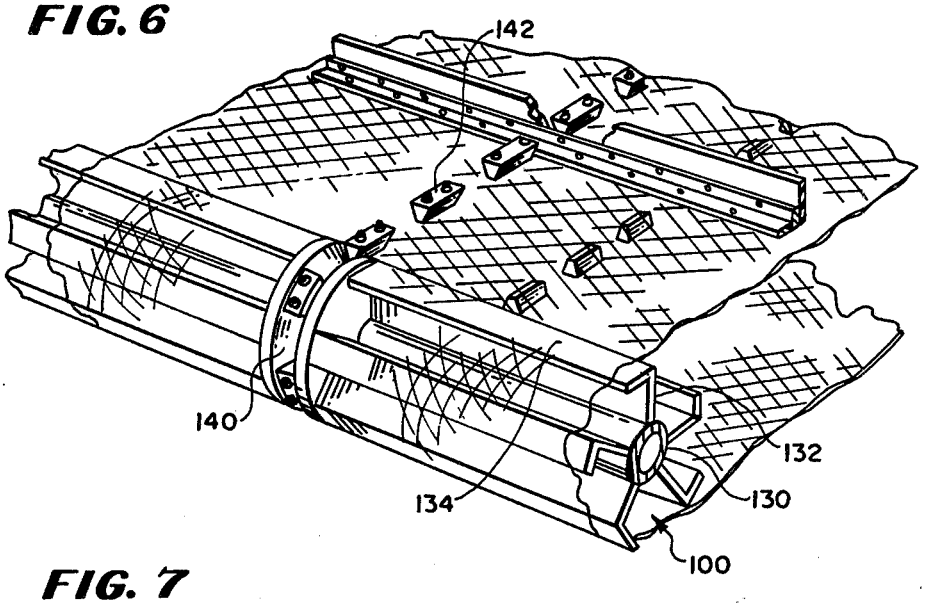
FIG. 6 is a fragmentary perspective view of the front portion of the screening and delivery conveyor of the machine shown in FIG. 1.

Referring now to FIG. 6, it will be apparent that the forward roller 100 of the screening and delivery conveyor 52 has a so-called non-binding configuration. In this respect, the roller 100 includes a longitudinally extending cylindrical hub 130 from which five longitudinally extending vanes 132 radially extend. At the outer end of each of the longitudinally and radially extending vanes 132 is a longitudinally and peripherally extending flange 134 which extends from the vane 132 in the counterclockwise direction or stated otherwise, in the direction of travel of the machine 10. The roller 100, however, is driven clockwise so that any material such as sand or earth that would collect in a trough defined by a vane 132 and flange 134 will be dumped out as the vane 132 and flange 134 rotate upwardly. This provides a non-binding, self-cleaning roller 100. Although hidden from view in the Figures, it is to be understood that the forward roller 86 of the transfer conveyor has a similar non-binding, self-cleaning configuration.

In order to maintain proper training and tracking of the mesh belt 54 over the rollers 100 and 102, the rollers 100 and 102 are provided with an annular groove 140 intermediate the ends thereof. This groove 140 mates with a plurality of V belt sections 142 which are mounted onto the underside of the conveyor belt 54. The V belt section 142 are preferably approximately 2 inches in length with a half inch spacing between each section 142. In this way, any skewing forces placed on the belt 54 by material 46 carried thereon will not jam up the conveyor belt 54 on the rollers 100 and 102. Yet, at the same time, the V belt sections tracking in the annular groove 140 and a like groove in the roller 102 will maintain proper training and tracking of the belt 54 on the rollers 100 and 102.

It will be understood that the transfer belt 90 is provided on the underside thereof with V belt sections similar to the V belt sections 142 which cooperate and mate with annular grooves (not shown) in the rollers 86 and 88 with each groove being situated intermediate the ends of the roller 86 or 88.

Figure 8:
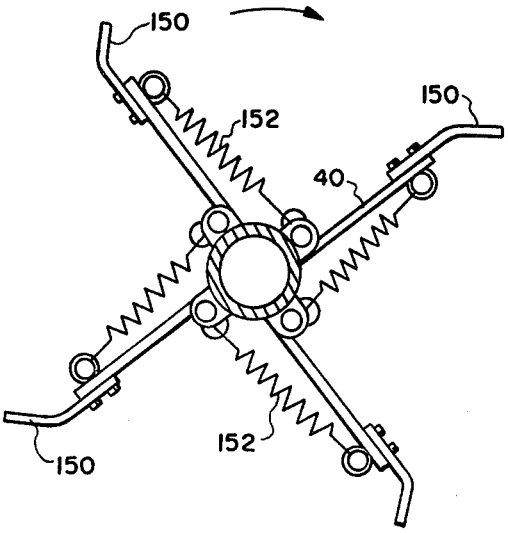
FIG. 8 is a vertical sectional view of the tine assembly mounted in the skimming section of the machine shown in FIG. 1.
Figure 9:
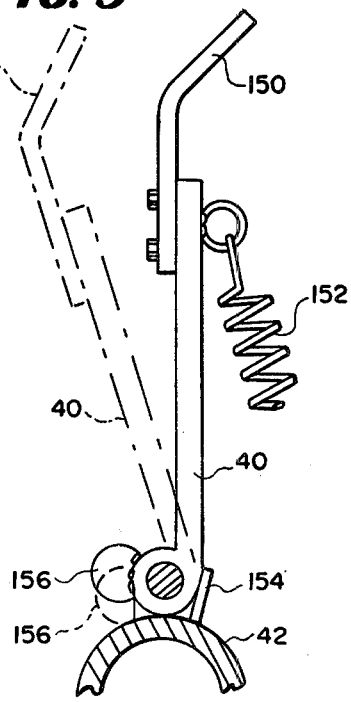
FIG. 9 is an enlarged fragmentary vertical sectional view of one tine showing two positions of the tine.

Referring now to FIGS. 1 and 4, it will be seen that the tine assembly includes four rows of tines 40 with each tine 40 being pivotally mounted to the shaft 42. As shown in FIGS. 8 and 9, each tine 40 has a scoop member 150 at the outer end thereof which is curved or angled in the direction of rotation of the tine assembly, namely in a clockwise direction. These scoop members 150 can be easily replaced when they are damaged in use of the machine such as when an immovable object is encountered or can be moved for mounting another type of outer end member on each tine 40.

To protect against damage of the scoop members 150, each of the tines 40 is spring-biased to a radially extended position by a spring 152. Also, to allow for deflection of each tine 40, the proximal end of each tine 40 has a first stop 154 and a second stop 156. In normal use, the first stop 154, which can be considered as mounted on the forward side of the tine 40, is pulled by the spring 152 against the outer surface of the shaft 42 where the tine 40 extends in a generally radial direction from the axis of rotation of the shaft 42. Then, when an immovable object is encountered, the tine 40 will be deflected backward from its position to the position shown in phantom in FIG. 9 where the tine 40 is skewed to the axis of rotation of the shaft 42 and where the second or rear stop 156 engages the outer surface of the shaft 42 as shown in FIG. 9.

Preferably, the tines 40 are made of a T-1 steel and have a length of between 6 and 24 inches depending upon the particular design parameters for a particular machine 10. Also, and as best shown in FIG. 1, the tines in one row extending 180° from the tines 40 in a third row with each tine 40 in each row being spaced from an adjacent tine 40. Then the tines in the second and the fourth rows extend 180° from each other and from the shaft 42 in the area of the spaces between the tines 40 in the first and third rows which are also 180° from each other and approximately 90° from the spaces between tines 40.

Further, as shown in FIG. 4, the hood 48 can be spring-biased by a spring mechanism 160 at the forward end of the hood 48 and pivoted at the rearward end thereof, either to the frame portion 44 of the carriage 56 or to an upper frame member (not shown) which would extend upwardly from the first carriage 28. In this way, when a large object, such as a coconut shaped rock, is encountered by the tines 40 and pushed against the hood 48, the hood 48 will move upwardly about its pivot point so as to allow the tines 40 to carry that rock upwardly and then rearwardly onto said transfer conveyor 50.

Figure 10:
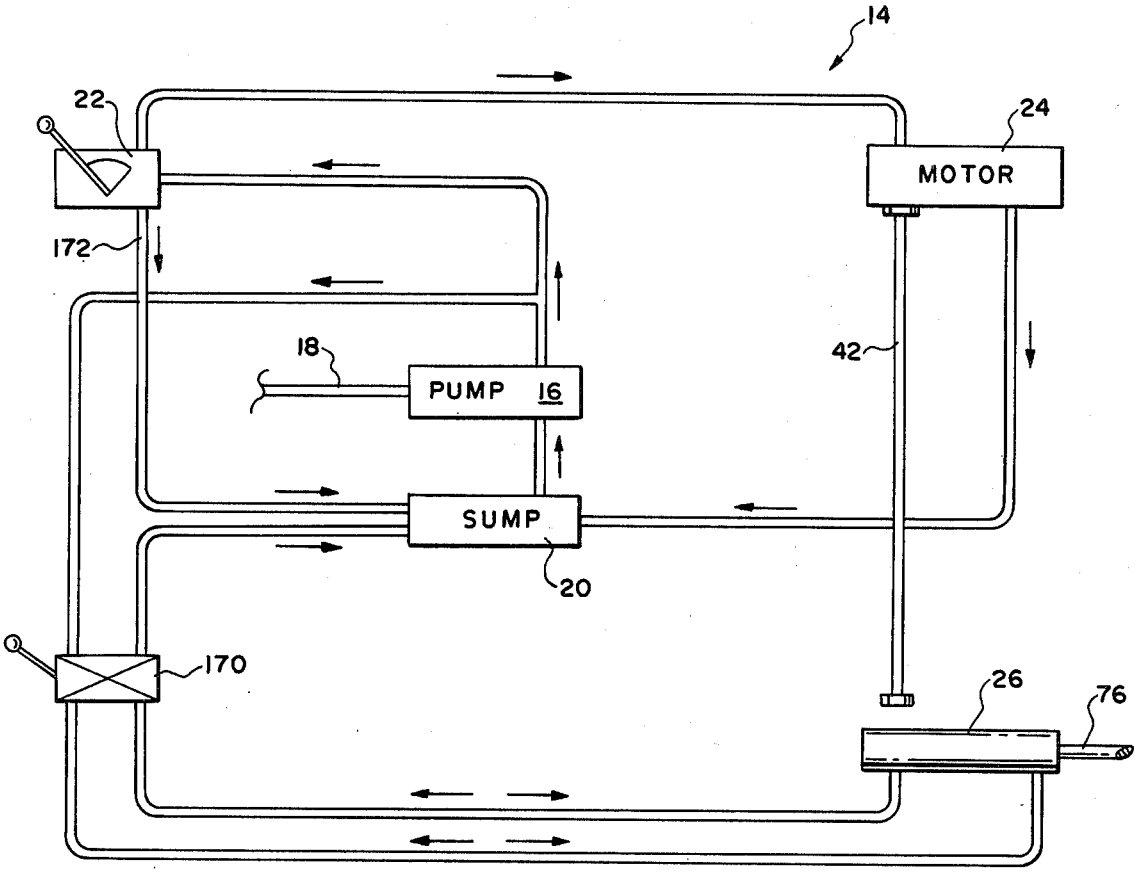
FIG. 10 is a schematic fluid circuit diagram of the hydraulic system for operating the machine shown in FIG. 1.

Referring now to FIG. 10, the hydraulic system 14 includes the motor 24 mounted on the first carriage 28, the piston and cylinder mechanism 26 also mounted on the carriage 28 by reason of its mounting on the side wall 74 of the hood 48, the pump 16 mounted on the tractor 12 and connected to the power take off shaft 18, the sump 20, also mounted on the tractor, the flow control valve 22 and a two way hydraulic control valve 170. The flow control valve 22 is of the type with an overload bypass for bypassing some of the fluid via a conduit 172 to the sump or reservoir 20.

The two way hydraulic control valve 170 is of the type which has a lock detent center for locking the valve 170 in any position after fluid has been delivered to one end of the piston and cylinder mechanism 26 and at the same time fluid has been relieved from the other end of the piston and cylinder mechanism 26.

With this hydraulic system 14 connected to the machine 10 as described above in connection with the description of FIGS. 1 and 10, an operator of the tractor 12 will operate the two way valve 170 to retract or extend the piston rod 76 to move the wheels 82 downwardly and forwardly or upwardly and rearwardly to adjust the position of the tine assembly as desired. Then, the operator will operate the flow control valve 22 as desired to control the speed of rotation of the output shaft from the hydraulic motor 24 as desired. In this respect, when picking up pieces of glass or bottles on a beach, one will want a slow speed of rotation. On the other hand, when cleaning an area with paper material, small pebbles, etc., one will operate at a faster speed.

As shown in FIG. 10, the output of the pump 16 is coupled by various conduits to the valves 22 and 170 and also in addition to the relief conduit 172 from the flow control valve 22 to the reservoir 20, there are fluid relief conduits from the two way valve 170 and the hydraulic motor 24 to the reservoir or sump 20.

Experiments conducted with a prototype of the machine 10 have indicated that it has great versatility, flexibility and ruggedness. In this respect and as noted above, the simple hydraulic system 14 and the mechanical linkage between the moving parts of the machine 10 enable it to withstand much abuse from water, sand, particulate matter, and debris. Moreover, the motor 24 has an overload bypass such that when an immovable object is encountered, the motor 24 stops. The motor 24 can then be put into reverse to remove oversized debris. This will only be necessary if the machine 10 should jam notwithstanding the spring mounting of the hood 48 and the spring mounting of the tines 40.

Also, the hydraulic system 14 enables an operator to easily control the speed of rotation of the tine assembly and the desired height of the tines above the earth surface to be cleaned and to reverse rotation when necessary. Moreover, the construction and arrangement of the parts of the conveyors 50 and 52 provide rugged conveyors for carrying debris from the skimming section 30 to the collection hopper 58 without the belts 90 or 54 coming off the rollers 86, 88; 100, 102, mounting same. This ruggedness has been proven empirically with tests over rocky beaches, sandy beaches, in water and on dry land where the machine 10 has functioned very effectively in picking up coins, jewelry, cigarette butts, paper cups, rocks, tar balls, beer cans, glass, glass bottles, socks, and other articles of clothing, etc.

From the foregoing description it will be apparent that the earth surface cleaning machine 10 of the present invention has a number of advantages, some of which have been described above and others of which are inherent in the invention. Also it will be apparent to those skilled in the art that modifications can be made to the machine 10 of the present invention without departing from the teachings of the invention. For example, the scoop members 150 can be replaced (a) with brushes for street sweeping with the mesh belt 54 and mesh hopper walls then being made of imperforate material, (b) with multi-finger rake-forming members for cleaning leaves and debris off of surface vegetation (grass) or (c) with cutting blades for mowing (hay or grass), e.g., wind rowing hay.

Accordingly, the scope of the invention is only to be limited as necessitated by the accompanying claims.

I claim:

1. An earth surface cleaning machine for cleaning the earth surfaces such as beaches, said machine including hitch means connectable to, adapted to be operated from, and pulled by a vehicle, such as a tractor, said machine comprising: a first wheeled carriage, skimming means conveyor transfer belt means, and conveying and screening means on said carriage, said skimming means comprising a plurality of spaced apart tines mounted on a shaft extending transversely of and journalled at the front end of said first carriage for skimming material from the earth surface as said machine is pulled over the earth surface by a vehicle, a hood over said tines, drive means for rotating said shaft in a direction so as to cause said tines to engage or skim the earth surface to engage and lift skimmed material forwardly of the direction of movement of said first carriage adjacent and along the undersurface of said hood in an upward rearward movement to be deposited on said conveyor transfer belt means to be conveyed and deposited on said conveying and screening means for conveying and simultaneously screening the skimmed material from small earth particulate matter such as sand transferred thereto by said conveyor transfer belt means, and receptacle means for collecting the screened material delivered thereto by said conveying and screening means.

2. The machine of claim 1 including a second carriage and wherein said collecting means are mounted on said second carriage.

3. The machine of claim 2 wherein said collecting means have a hopper shape and include a bottom wall mounted on said carriage, a back wall, and two side walls with an open side facing and positioned adjacent said delivery means.

4. The machine of claim 3 wherein said side walls, back wall and bottom wall of said hopper shaped collecting means are made of a mesh material to permit small earth particulate matter to fall through said mesh walls onto the earth surface.

5. The machine of claim 4 wherein said side walls are trapezoidal in shape with a short forward edge and a longer back edge.

6. The machine of claim 3 wherein said second carriage has an axle mounted thereon with a wheel at each end of said said axle and the forward end of said second carriage having hitch means for coupling to the rear end of said first carriage.

7. The machine of claim 1 wherein said conveyor transfer means include a transfer conveyor having a continuous wide belt positioned on said carriage between said skimming means and said conveying and screening means.

8. The machine of claim 7 wherein said conveying and screening means are defined by a screening and delivery conveyor mounted on said first carriage between said conveyor transfer means and said collecting means.

9. The machine of claim 8 wherein said conveyor transfer means comprise a transfer conveyor, shorter than said screening and delivery conveyor, mounted on said first carriage between said skimming means and said screening and delivery conveyor.

10. The machine of claim 1 wherein said hood is pivotally mounted at the rear end thereof to the framework of said carriage and is spring mounted at the forward lower end thereof to said carriage so that large objects such as rocks will be pushed upwardly against the hood and deflect said hood as they are carried by said tines of said skimming means to said transfer conveyor.

11. The machine of claim 1 wherein each of said tines is pivotally mounted to said shaft and has a first stop and a second stop, each said tine further having a spring coupled to said shaft at one end and to said tine near the distal end thereof at the other end such that said spring pulls each tine toward said shaft with said first stop thereof engaging said shaft to hold said tine in position extending radially outwardly from said shaft and said spring and said rear stop allowing said tine to be deflected to a skew position relative to said shaft when an immovable object in or at the earth surface is encountered by said machine.

12. The machine of claim 1 wherein each of said tines has an arcuate scoop member at the distal end thereof which is curved into the direction of rotation of the tine which is clockwise relative to the horizontal line of travel of said shaft in a direction transverse to said shaft when said machine moves forwardly.

13. The machine of claim 1 wherein said tines are arranged in a predetermined array on said shaft, said array including four equally spaced rows of tines on the shaft which are spaced from adjacent rows by approximately 90°, the tines in alternate rows extending from said shaft in the same plane in directions 180° opposite from each other.

14. The machine of claim 13 wherein the tines in one row are spaced apart with a predetermined spacing between each tine and the tines in each adjacent row on either side of said first named row extend from said shaft in the area of said space between the tines in said first named row and at a position about 90° on either side of said space in said first named row.

15. The machine of claim 1 wherein said skimming means include a motor mounted to said shaft for rotating said shaft.

16. The machine of claim 15 wherein said transfer conveyor comprises a wide short belt which is received over a forward roller and a rearward roller rotatably journalled on said first carriage, one end of said tine carrying shaft being coupled to said motor and the other end thereof having a pulley mounted thereon and being coupled by a drive belt to said forward roller of said transfer conveyor for driving same.

17. The machine of claim 16 wherein said screening and delivery conveyor comprises a continuous mesh belt mounted on and between a forward roller and a rearward roller, said forward roller being journalled to said first carriage beneath the rearward roller of said transfer conveyor and said rearward roller of said screening and delivery conveyor being positioned above and adjacent said collecting means, and said rearward roller of said transfer conveyor being coupled by a drive belt to said forward roller of said screening and delivery conveyor thereby to drive same.

18. The machine of claim 16 wherein said belt of said transfer conveyor has a plurality of transversely extending, longitudinally spaced ribs thereon which are adapted to engage and hold material deposited thereon by said skimming means as it is being transferred to said screening and delivery conveyor.

19. The machine of claim 18 wherein each of said ribs is made of resilient flexible material.

20. The machine of claim 16 wherein said forward and rearward rollers of said transfer conveyor are journalled in a manner preventing lateral movement of said rollers and wherein said rollers and said transfer conveyor belt have cooperating means for preventing lateral movement of said belt off of said rollers.

21. The machine of claim 20 wherein said means for preventing lateral movement of said transfer conveyor belt laterally of said rollers includes an annular groove in each of said rollers intermediate the ends thereof and a plurality of spaced apart V belt sections secured to the underside of said transfer conveyor belt, said V belt sections being received in said annular groove in each said roller on rotation thereof so as to train said belt on said rollers and to maintain proper tracking of said belt on said rollers.

22. The machine of claim 17 wherein said continuous mesh belt has a plurality of transversely extending, longitudinally spaced ribs thereon which are adapted to engage and hold material deposited therein by said transfer conveyor as it is being delivered to said collection means.

23. The machine of claim 22 wherein each of said ribs is made of a resilient flexible material.

24. The machine of claim 22 wherein said forward and rearward rollers of said screening and delivery conveyor are journalled in a manner preventing lateral movement of said rollers and wherein said rollers and said continuous mesh belt have cooperating means for preventing lateral movement of said belt off of said rollers.

25. The machine of claim 24 wherein said means for preventing lateral movement of said continuous mesh belt laterally of said rollers includes an annular groove in each of said rollers intermediate the ends thereof and a plurality of spaced apart V belt sections secured to the upper side of said continuous mesh belt intermediate the side edges thereof, said V belt sections being received in said annular groove in each said roller on rotation thereof so as to train said belt on said rollers and to maintain proper tracking of said belt on said rollers.

26. The machine of claim 16 wherein at least said forward roller of said rollers of said transfer conveyor includes an elongate cylindrical hub and a plurality of radially and longitudinally extending vanes each extending longitudinally of the axis of the hub and radially outwardly from the hub and each having a longitudinally and peripherally extending flange which extends from the vane in a counterclockwise direction and in a direction of horizontal movement of the machine which is opposite the clockwise direction of rotation of said forward roller such that small earth particulate matter finding its way between the forward roller and said transfer conveyor belt will collect in the trough area defined by each vane and flange and will be dropped from said roller on its clockwise rotation thereby to prevent clogging and binding between the forward roller and the undersurface of the conveyor belt.

27. The machine of claim 17 wherein at least said forward roller of said rollers of said continuous mesh conveyor includes an elongate cylindrical hub and a plurality of radially and longitudinally extending vanes each extending longitudinally of the axis of the hub and radially outwardly from the hub and each having a longitudinally and peripherally extending flange which extends from the vane in a counterclockwise direction and in a direction of horizontal movement of the machine which is opposite the clockwise direction of rotation of said forward roller such that small earth particulate matter finding its way between the forward roller and said continuous mesh conveyor will collect in the trough area defined by each vane and flange and will be dropped from said roller on its clockwise rotation thereby to prevent clogging and binding between the forward roller and the undersurface of the continuous mesh belt.

28. The machine according to claim 16 wherein said transfer conveyor belt is mounted on said first carriage so as to have an active flight extending at an angle of between 15° and 50° to the horizontal.

29. The machine according to claim 17 wherein said continuous mesh screening and delivery conveyor belt is mounted on said first carriage so as to have an active flight on the upper surface thereof extending at an angle of between 15° and 50° to the horizontal.

30. The machine of claim 17 wherein said continuous mesh conveyor belt is made of one half inch mesh screen.

31. The machine of claim 21 wherein said V belt sections are approximately 2 inches in length with a one half inch spacing therebetween.

32. The machine of claim 25 wherein said V belt sections are approximately 2 inches in length with a one half inch spacing therebetween.

33. The machine of claim 16 wherein said transfer conveyor belt is approximately 4 feet in width and has a length such that the active flight on the upper surface thereof is between 2 and 4 feet in length.

34. The machine of claim 17 wherein said continuous mesh screening and delivery conveyor belt is 4 feet in width and has a length such that the active flight on the upper surface thereof is approximately 5 to 6 feet in length.

35. The machine of claim 1 wherein said tines are made of steel and have a length of between 6 and 24 inches.

36. The machine of claim 1 wherein said first carriage includes an axle mounting a wheel at each end thereof, and a raising and lowering mechanism coupled to the axle and to a framework of said first carriage and being operable to raise or lower said wheels relative to said framework of said carriage thereby to raise and lower said skimming means to adjust the path of travel of said tines on or into the earth surface on rotation of said tines.

37. The machine of claim 36 wherein said raising and lowering mechanism includes control means for controlling the position of said wheels relative to said framework of said carriage so as to position said tines to skim between a height of approximately 2 inches above the earth surface to a depth of up to 12 inches below the earth surface.

38. The machine of claim 36 wherein said raising and lowering mechanism includes a hydraulic piston and cylinder mechanism and wherein said control means include a two way hydraulic control valve with lock detent center coupled to said hydraulic piston and cylinder mechanism, to a source of pressurized hydraulic fluid, and to a reservoir for hydraulic fluid.

39. The machine of claim 36 wherein the forward end of said first carriage has hitch means thereon for coupling said first carriage to the rear end of a tractor and wherein said machine further includes a hydraulic system having portions mounted on said tractor and including a pump connected to and driven by a power take off shaft at the rear end of the tractor, a reservoir for hydraulic fluid mounted on the rear end of the tractor for supplying hydraulic fluid to said pump, a hydraulic motor mounted on said first carriage and coupled to said tine carrying shaft of said skimming means, a hydraulic piston and cylinder mechanism mounted on said first carriage and forming said raising and lowering mechanism for raising and lowering said wheels of said first carriage, and two valves, a two way hydraulic control valve with lock detent center and a flow control valve with overload bypass, both mounted on said tractor, said hydraulic system further including fluid couplings between the outlet of said pump and said two way hydraulic control valve and said flow control valve, a fluid coupling between said two way hydraulic control valve and one end of said piston and cylinder mechanism, a fluid coupling between said two way hydraulic control valve and the other end of said piston and cylinder mechanism, a fluid coupling between said flow control valve and said hydraulic motor, a fluid relief coupling between said flow control valve and said reservoir and a fluid relief coupling between said two way hydraulic control valve and said reservoir, whereby an operator pulling the machine with a tractor can raise or lower the rotating tines by operation of the two way hydraulic control valve and can speed up or slow down the rotation of the tines by operation of the flow control valve which controls the speed of rotation of an output shaft of said hydraulic motor.

40. The machine of claim 16 wherein said first carriage has mounted thereon first and second side deflectors on either side of said transfer conveyor.

41. The machine of claim 40 wherein said first and second deflectors are positioned to angle outwardly from the side edge of the upper flight of the conveyor belt of said transfer conveyor so as to form a V shaped trough with the upper flight of said transfer conveyor.

42. The machine of claim 41 wherein each of said side deflectors has a skirt of elastomeric material extending downwardly therefrom and in engagement with the upper flight of said transfer conveyor belt on one side thereof.

43. The machine of claim 17 wherein said first carriage has mounted thereon first and second side deflectors on either side of said mesh conveyor of said screening and delivery conveyor.

44. The machine of claim 43 wherein said first and second deflectors are positioned to angle outwardly from the side edge of the upper flight of the mesh conveyor belt of said screening and delivery conveyor so as to form a V shaped trough with the upper flight of said conveyor.

45. The machine of claim 44 wherein each of said side deflectors has a skirt of elastomeric material extending downwardly therefrom and in engagement with the upper flight of said mesh conveyor of said screening and delivery conveyor on one side thereof.

46. The machine of claim 1 wherein each of said tines has a replaceable tip member.

47. The machine of claim 46 wherein said tip member is selected from the class consisting of (a) an arcuate or inclined scoop member, (b) a multi-finger rake-like member, or (c) a cutting blade.

* * * * *